United States Patent [19]

DeWitt et al.

[11] 4,112,550

[45] Sep. 12, 1978

[54] SUSPENDED CEILING HOOK

[76] Inventors: Stuart DeWitt; James S. DeWitt, both of 799 Wendover Blvd., Muskegon, Mich. 49441

[21] Appl. No.: 796,765

[22] Filed: May 13, 1977

[51] Int. Cl.[2] ..... A44B 21/00; E04C 17/18

[52] U.S. Cl. ..... 24/73 BP; 24/73 HH; 248/228

[58] Field of Search ..... 24/73 R, 73 BP, 73 HH, 24/84 R; 248/228

[56] References Cited

U.S. PATENT DOCUMENTS

| | | | |
|---|---|---|---|
| 718,545 | 1/1903 | Streeter | 248/228 |
| 862,372 | 8/1907 | Alexander | 248/228 |
| 2,954,200 | 9/1960 | Gannon et al. | 24/73 BP |
| 3,618,176 | 11/1971 | Barnes | 24/84 R |

FOREIGN PATENT DOCUMENTS

| | | | |
|---|---|---|---|
| 2,252,773 | 6/1975 | France | 248/228 |
| 401,386 | 5/1966 | Switzerland | 248/228 |
| 369,173 | 3/1932 | United Kingdom | 248/228 |
| 369,174 | 3/1932 | United Kingdom | 248/228 |

*Primary Examiner*—Louis K. Rimrodt
*Attorney, Agent, or Firm*—McGarry & Waters

[57] ABSTRACT

A one piece suspended ceiling hook comprising an upper rail gripping portion and a downwardly extending hook portion. The upper portion includes two inwardly extending and opposing flanges having inner edges spaced apart from each other. A recess is formed within the upper portion with the inwardly extending flanges defining the upper border of the recess. The recess is adapted to receive a lower horizontal rim of a suspended ceiling beam. The upper portion is capable of flexing. Tabs extend outwardly and downwardly from the outer portion of the upper portion for manual movement to an inward position such that the upper portion flexes and the two opposing flanges move outwardly such that the inner edges of the flanges are a greater distance apart than the width of the lower rim of the suspended ceiling beam. The downwardly extending hook portion has edges which about the tabs when flexed to limit the extent the tabs can flex the upper portion.

9 Claims, 5 Drawing Figures

SUSPENDED CEILING HOOK

BACKGROUND OF THE INVENTION

1. Field of the Invention

This invention relates to a suspending hook for attachment of horizontal beams of a suspended ceiling.

2. State of the Prior Art

Suspended ceilings present a particular problem for suspending hooks therefrom. The suspended ceiling panels themselves do not have the sufficient strength to support appreciable weight which may be suspended from a hook which is screwed therein or supported by a toggle bolt or similar device.

In order for one to hang a relatively heavy object from a suspended ceiling, the object generally must be hung from the horizontal beams which support the suspended ceiling panels.

A two piece hanger clip which is mountable on the beam of a suspended ceiling is disclosed in the U.S. Pat. No. 3,618,176 issued to Barnes on Nov. 9, 1971. The Barnes reference discloses a hanger clip made from two parts. Each part has a downwardly extending hook portion, an outwardly extending horizontal lower flange, an outer edge bent upwardly, and an upper flange extending inwardly from the bent edge. An inner connector portion extends from the forward edge of one clip component and from a rearward edge of the second clip component. The two components interconnect such that the clip component which has its flanges on the right portion, is adjacent the left side of the hook portion of the second component. In this fashion, the flange portions can securely engage the lower horizontal rim of a suspended beam and together form a unitary clip.

SUMMARY OF THE INVENTION

According to the invention, a one piece hanger device has an upper portion and a downwardly extending hanger portion. The upper portion preferably includes a horizontal plate having two opposing upwardly turned edges and two opposing inwardly extending flanges attached to the upwardly bent edges. A recess, defined within the upper portion between the plate, outer edges, and upposing flanges, is adapted to receive a rim with two outwardly extending planar flanges of a support member. The recess is suitable to receive the lower rim of a beam of a suspended ceiling assembly. A space exists between the inner edges of the two opposing flanges. The space is narrower than the width of the lower horizontal rim of a suspended beam.

The upwardly turned edges, on the contrary, are spaced slightly farther apart than the width of the lower rim of the suspended beam.

The upper portion includes means for moving the flanges outwardly to increase the space between the inner edges to allow the rim to be received or withdrawn from the recess. In one embodiment, the upper portion is made of a flexible plastic so that it is capable of flexing to a degree such that the flanges can flex to a degree greater than the width of the lower rim of the suspended beam and includes flexing means for flexing the upper portion preferably the flanges are resiliently biased to an inward position to engage the lower rim of a suspended beam.

In one embodiment, the flexing means includes two downwardly and outwardly extending tabs mounted on a horizontal plate of the upper portion near the upwardly bent edges. The tabs are designed for manual manipulation so that they can be squeezed inwardly and downwardly to flex the flanges outwardly.

In one embodiment, at least one groove is recessed in the upper surface of the horizontal plate in close proximity to and parallel to one of the two upwardly bent edges. The tabs are mounted to the horizontal plate at a point farther out from the center axis and where the parallel grooves are positioned. As the tab means are squeezed, a significant amount of the flexing occurs within the thin strip of the upper plate directly below the recessed grooves.

One specific embodiment includes means for preventing the upper portion from overflexing. Preferably, the means for preventing the upper portion from overflexing is an outwardly extending flange of the hook portion which abuts the tabs when the tabs are squeezed to a certain position. The flange prevents the tabs from being moved closer together which would overflex the upper portion.

In one specific embodiment, the inwardly extending flanges, horizontal plate, tabs, and downwardly extending hanger portion are integrally molded from a thermoplastic material.

In operation, the hanger device securely hangs from a lower rim of a suspended ceiling beam. The mere squeezing of the tabs allows one to mount or remove the device from the beam. In this fashion, a hook can be secured to a suspended ceiling.

DETAILED DESCRIPTION OF THE PREFERRED EMBODIMENT

Figure 1:
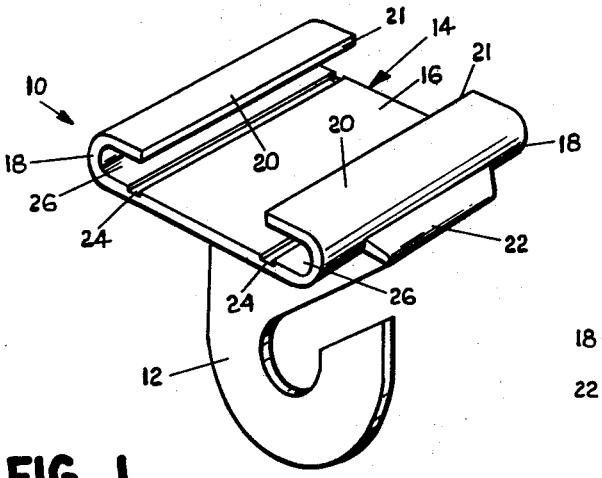
FIG. 1 is a perspective view of an embodiment according to the invention.
Figure 2:
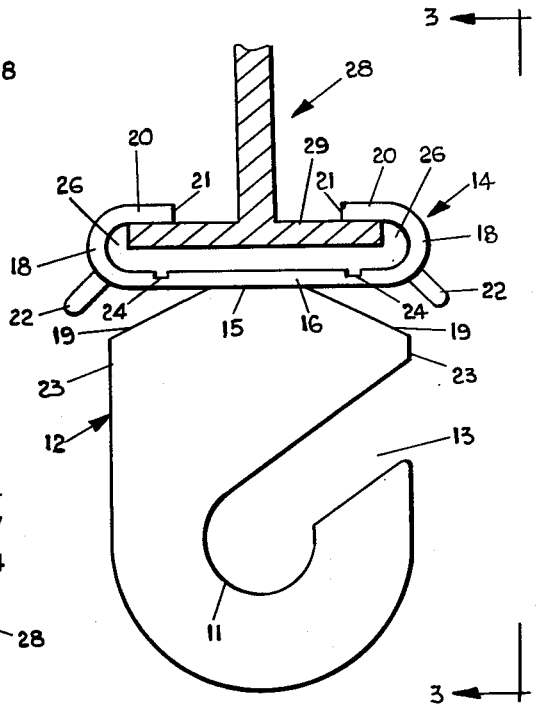
FIG. 2 is a side elevational view of the hook shown in FIG. 1.
Figure 4:
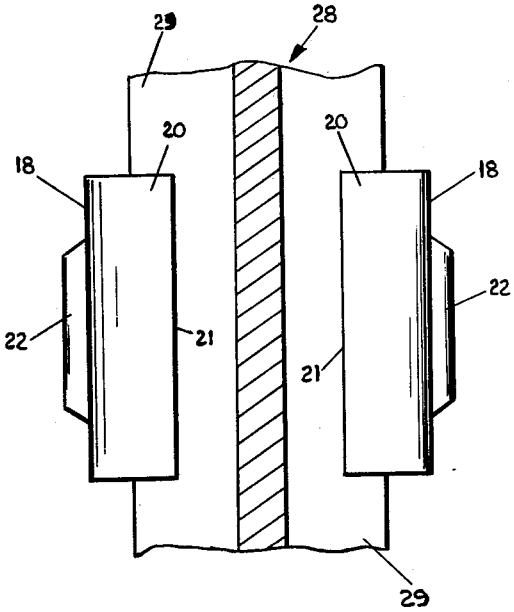
FIG. 4 is a top plan view taken along the lines 4—4 as shown in FIG. 3.

Referring to the drawings, particularly FIG. 1, a suspended ceiling hook 10 has a downwardly extending hook portion 12, an upper portion 14 including a horizontal plate 16, two upwardly curved edges 18, and two inwardly extending flanges 20. The flanges 20 have inner edges 21 spaced apart at a distance less than the width of the lower rim 29 of a beam 28 as shown in FIGS. 2 and 4. Tabs 22 extend downwardly and outwardly from the horizontal plate 16. Grooves 24 run parallel to the curved outward edges 18 and are recessed in the top surface of the horizontal plate 16.

As more clearly shown in FIG. 2, the inwardly extending flanges 20 are spaced apart from plate 16 to define a recess 26. The lower rim 29 of the suspended beam 28 fits within the recess to securely suspend the hook.

Figure 3:
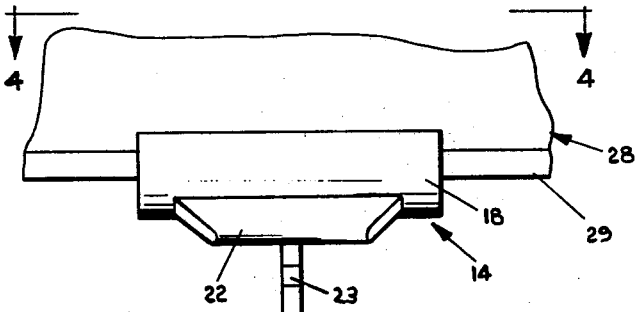
FIG. 3 is a side elevational view along the lines 3—3 as shown in FIG. 2.

The hook portion 12, as shown in FIGS. 2 and 3, defines a plane which is perpendicular to the plate defined by the horizontal plate 16 and is transverse to the horizontal lines defined by the grooves 24. The hook portion 12 extends from the central area 15 of the plate 16 between the two grooves 24. Two outwardly extending flanges 19 extend laterally beyond the two grooves 24 and are spaced below the plate 16. The flanges 19 have an upper edge which slopes downwardly and outwardly from the central connection to the plate 16, thereby forming a diverging slot therewith. The outer edges 23 of the flanges 19 are positioned laterally between tabs 22. The hook portion 12 has an angled slot 13 therethrough with a rounded inner end 11 adapted to receive a conventional cylindrical curtain rod and the like (not shown).

Tabs 22, as shown in FIGS. 2, 3, and 4, extend downwardly and outwardly beyond the outer edges 18. The tabs define a surface 30 which can be manually grasped to squeeze the tabs inwardly as shown in FIG. 5.

Figure 5:
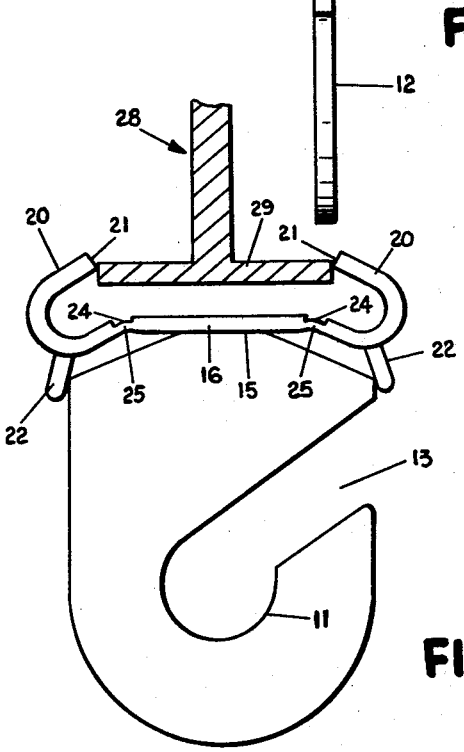
FIG. 5 is a side elevational view as shown in FIG. 2 with the tabs squeezed inwardly and the flanges flexed outwardly.

Grooves 24, as shown in FIGS. 2 and 5, are recessed in the upper surface of the horizontal plate. The grooves are located to the center of the tabs 22. The recessed grooves allow a substantial amount of flex to occur within the thin portion 25 of the horizontal plate 16 directly below the grooves.

In operation, one needs to only grasp tabs 22 between the forefinger and thumb and squeeze them inwardly to flex portion 25. The flexing of portion 25 outwardly moves the flanges 20 so that the inner edges 21 of the flanges extend outwardly to define a space not less than the width of the rim 29 of the beam 28 as clearly shown in FIG. 5. At the same time, the ends of the plate 16 flex downwardly in the diverging slot formed by flanges 19 and plate 16. The flanges will then flex outwardly and the hook can be placed adjacent the lower rim 29 of the beam 28. The tabs 22 are released and the flanges 20 resiliently return to their original shape and engage rim 29 as shown in FIG. 2. The release of the hook 10 from the beam is accomplished with the same process. The tabs 22 are squeezed, the hook 10 is then removed from the rim 29, and then the tabs 22 are released to allow the flanges 20 to resiliently return to their unflexed position.

The tabs 22 abut the outer edges 23 of flanges 19 when in the squeezed position. The flanges 19 prevent the tabs 21 from being squeezed beyond the position necessary to disengage the flanges 20 from the rim 29 and prevent any unnecessary stress to be inflicted on the upper portion when it is flexed.

The hook is desirably integrally formed of one piece of a flexible, resilient plastic material such as nylon, polyethylene, polypropylene, polyvinyl chloride, polycaprolactams, and the like. Such plastics can conveniently be injected molded to form the hook in one piece.

In this fashion, many objects can be easily hung from a suspended ceiling wherein prior to this time, greater difficulty was involved in suspending objects from suspended ceilings.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. A hanger device for attachment to a support member with a rim with two outwardly extending planar edges comprising:

an integrally formed upper portion including two inwardly extending and opposing flanges having inner edges spaced apart from each other and means defining a flexure point for each of said opposing flanges;

a recess formed within the upper portion with the inwardly extending flanges defining the upper border of the recess, the recess adapted to receive the rim of the support member;

tab means for manually moving the flanges outwardly about the flexure point to enlarge the distance between the inner edges to allow the rim of the support member to be received in or withdrawn from the recess, the tab means connected to the outer portion of the upper portion and extending downwardly and outwardly therefrom for manual movement to inward positions such that the flanges move resiliently about the flexure point when the tab means are manually moved inwardly, the flanges being adapted to securely engage the rim of the support member when the tab means are released; and a downwardly extending hanger portion connected to the upper portion.

2. A hanger device defined in claim 1 wherein the flexure point defining means allows flexing of the flanges outwardly to a flexed position such that the inner edges of the flanges are a greater distance apart than the width of the lower rim of the beam.

3. A hanger device defined in claim 1 wherein the flexing means includes at least one parallel groove recessed in the outer portions of the upper portion and defines thinner portions in the upper portion set between the two tab means, each groove being substantially parallel to the inner edges of the opposing flanges such that when the upper portion is flexed, substantially most of the flexure point defining occurs in the thinner portions defined by the grooves.

4. A hanger device defined in claim 3 wherein the flexure point defining means includes two parallel grooves recessed in an upper surface of the upper portion and the hanger portion is connected to a central area of the upper portion between the two grooves.

5. A hanger device defined in claim 1 and further comprising means for limiting the extent of flexing of the upper portion.

6. A hanger device as defined in claim 5 wherein the preventing means includes outwardly extending flanges from the hanger portion which abuts the tab means when the tab means are in an inward position and prevents the tab means from being moved further inwardly.

7. A hanger device defined in claim 1 wherein the upper portion and hanger portion are integrally formed.

8. A hanger device for attachment to a support member with a rim with two outwardly extending planar edges comprising:

an upper portion including two integrally formed and inwardly extending and opposing flanges having inner edges spaced apart from each other, the upper portion capable of flexing;

a recess formed within the upper portion with the inwardly extending flanges defining the upper border of the recess, the recess adapted to receive the rim of the support member;

means for flexing the flanges outwardly to enlarge the distance between the inner edges to allow the rim of the support member to be received or withdrawn from the recess;

the flanges being resiliently biased to an inward position adopted to engage the rim of the support member;

a downwardly extending hanger portion connected to the upper portion; and means for limiting the extent of flexing of the upper portion.

9. A hanger device as defined in claim 8 wherein the flexing means includes tab means connected to the outer portion of the upper portion and extending downwardly and outwardly therefrom for manual movement to an inward position such that the flanges move outwardly when the tab means are manually moved inwardly; and the limiting means includes outwardly extending flanges from the hanger portion which abut the tab means when the tab means are in an inward position and prevents the tab means from being moved further inwardly.

* * * * *